US005361952A

United States Patent [19]

Gold

[11] Patent Number: 5,361,952

[45] Date of Patent: Nov. 8, 1994

[54] BABY CARRIER

[76] Inventor: Nancy Gold, 2696 Troy Rd., Schenectady, N.Y. 12309

[21] Appl. No.: 35,690

[22] Filed: Mar. 23, 1993

[51] Int. Cl.[5] ..... A47D 13/02

[52] U.S. Cl. ..... 224/159; 224/208

[58] Field of Search ..... 224/159, 160, 161, 158, 224/208

[56] References Cited

U.S. PATENT DOCUMENTS

| | | | |
|---|---|---|---|
| 3,575,326 | 4/1971 | Chappell | 224/159 |
| 3,780,919 | 12/1973 | Hansson | 224/160 |
| 4,149,687 | 4/1979 | Nunemacher | 224/159 |
| 4,467,945 | 8/1984 | Schaapveld | 224/160 |
| 4,724,988 | 2/1988 | Tucker | 224/160 |
| 4,986,458 | 1/1991 | Linday | 224/160 |
| 5,178,309 | 1/1993 | Bicheler et al. | 224/160 |

FOREIGN PATENT DOCUMENTS

| | | | |
|---|---|---|---|
| 2048839 | 2/1993 | Canada | 224/159 |

*Primary Examiner*—Linda J. Sholl

*Attorney, Agent, or Firm*—Schmeiser, Morelle & Watts

[57] ABSTRACT

A soft-type baby carrier for supporting a baby in a rearwardly facing direction on the front or side torso of a wearer. The baby carrier includes an adjustable pouch shaped baby seat for supporting a baby in a substantially upright, sitting position, an adjustable waist belt and an adjustable yoke system for comfortably supporting the baby carrier about the neck of a wearer.

9 Claims, 4 Drawing Sheets

BABY CARRIER

FIELD OF THE INVENTION

The present invention relates to a baby transporting system and, more particularly, to a baby carrier for supporting a baby in a rearwardly facing direction on the front or side torso of a parent or other adult. The baby carrier includes an adjustable, pouch shaped baby seat for supporting a baby in a substantially upright, sitting position, an adjustable waist belt and a unique, adjustable yoke harness system for comfortably supporting the baby carrier about the neck of a wearer.

BACKGROUND OF THE INVENTION

In today's hectic world, many parents attempt to perform a plethora of activities while simultaneously carrying or supporting a baby with their hands or arms. Unfortunately, as most parents can attest, it is oftentimes impossible to adequately, safely, or completely accomplish many activities while holding a baby. The manufacturers of baby equipment have recently ameliorated this problem to a certain degree by introducing many different types of baby carrying systems which offer "hands-free" operation. The two most popular baby carrying systems include the frame-type carriers which are customarily supported on the back of a wearer and the soft-type carriers which are supported on the front and/or hip areas of a wearer.

The soft-type carriers, which generally incorporate a pouch shaped baby seat, usually support a baby in a rearwardly facing direction in order to position the baby and wearer of the carrier in a mutually facing relationship. This positioning provides the baby with a constant, unobstructed and comforting view of the wearer, while simultaneously allowing the baby to examine the surrounding environment. Additionally, the warmth emanating from the wearer of the carrier and the tactile and aural sensations produced by the heartbeat and breathing of the wearer, further comfort the baby by simulating their mother's womb.

Although heretofore available soft-type carriers provide many benefits for parents and the like, they suffer from many disadvantages due to their inadequate, complex and uncomfortable harnessing arrangements. In particular, the confusingly large number of harness straps incorporated within the harnessing arrangements of prior art soft-type carriers, inadequately distribute the weight of a baby on the shoulders, neck and other areas of a wearer's torso. As a result, many of the presently available soft-type carriers produce a forward, downward force on the upper torso of the wearer, thereby causing the wearer to hunch over uncomfortably. Consequently, the wearer is often prematurely fatigued and/or subjected to neck and back pain due to the deficient design of prior art soft-type baby carriers. The inadequacies of the harnessing arrangements are due in part to the relative orientation of the harness straps, the pouch shaped baby seat and the neck, shoulders, arms and other sections of the wearer's torso.

SUMMARY OF THE INVENTION

In order to avoid the disadvantages of the prior art, the present invention provides a novel soft-type baby carrier having an adjustable yoke harnessing system, an adjustable pouch shaped baby seat and an adjustable waistbelt.

The baby carrier of the present invention includes a pouch shaped baby seat having a padded, upwardly extending support panel for supporting and partially encircling the buttock, back, neck and head areas of a baby, a nonpadded, upwardly extending support panel for supporting and encircling the front torso of the baby, a size adjustable strap arrangement for securing the baby within the pouch shaped baby seat and two size-adjustable openings for receiving the legs of a baby therethrough.

The size adjustable strap arrangement for securing the baby within the pouch shaped baby seat preferably comprises two buckles symmetrically positioned on opposite sides on the front (forwardly facing), exterior side of the padded, upwardly extending support panel and two straps each having a first end section which is adapted to be adjustably received in one of the buckles and a second end section which is fixedly attached to opposing sides of the nonpadded, upwardly extending support panel. A transversely extending support strap, which is fastened between each of the buckles across the front, exterior side of the padded, upwardly extending support panel, provides additional support for the back area of a baby sitting within the pouch shaped baby seat.

Each of the size adjustable leg openings, which extend through opposing side areas of the pouch shaped baby seat, preferably includes a cord which extends about at least a portion of the periphery of the leg opening. A slidable, spring biased stop member, having a looped and knotted portion of the cord inserted therethrough, is utilized to provide and maintain a desired leg opening circumference.

The adjustable waistbelt of the instant invention is slidably received through an elongated sheath located proximate a bottom region of the size adjustable leg openings, below the intersection of the padded and nonpadded, upwardly extending support panels. The waistbelt includes first and second end portions each having complementary buckle members adjustably positioned proximate opposing ends thereof. Advantageously, each buckle member is adapted to be independently positioned along the length of a waistbelt end portion, thereby facilitating the adjustment of the waistbelt. In operation, the end portions of the waistbelt are secured about the back of the wearer by suitably joining the complementary buckle members. By allowing the waistbelt to freely slide within the elongated sheath, the position of the pouch shaped baby seat relative to the torso of the wearer may be easily adjusted without necessitating the unbuckling of the waistbelt.

The baby carrier of the present invention incorporates a novel yoke harnessing system which is adapted to more comfortably distribute the weight of baby about the upper torso of a wearer. The harnessing system includes a padded yoke having a rear portion which encircles the rear of a wearer's neck and first and second opposing end portions which extend over the front of the wearer's shoulders.

A pair of adjustable yoke to baby seat attachment straps are provided for securing the opposing end portions of the padded yoke to a pair of buckles which are symmetrically disposed on opposite sides of the front, exterior side of the padded, upwardly extending support panel. The symmetrically disposed buckles are fastened to first and second support straps which extend diagonally downward across a portion of the front, exterior side of the padded support panel in a V-shaped configuration. Preferably, the first and second support straps are fixedly secured along their entire length to the padded support panel. Advantageously, the V-shaped configuration of the first and second support straps provides supplementary support for the back area of a baby sitting in the pouch shaped baby seat. Further, the V-shaped support strap configuration, in conjunction with the yoke to baby seat attachment straps, augment the cradling action of the pouch shaped baby seat by pulling the periphery of the padded support panel around the sides of a baby sitting therein. In order to provide an additional degree of comfort, the yoke to baby seat attachment straps may be enclosed along a substantial portion of their length with a padded sheath.

One or more bib loops, each comprising a looped section of cord, may be secured to the first and second opposing end portions of the padded yoke or an upper section of the yoke to baby seat attachment straps in order to secure a wide variety of bibs, towels or the like to the baby carrier of the present invention. For example, a bib may be tied between two bib loops disposed on the end portions of the yoke to protect a wearer's clothing from baby vomit or drool.

A pair of adjustable yoke to waistbelt attachment straps are provided for securing the rear portion of the padded yoke to the waistbelt proximate the pouch shaped baby seat. In particular, the rear portion of the padded yoke includes two symmetrically positioned buckles for adjustably receiving first end sections of the yoke to waistbelt attachment straps. The second end sections of each yoke to waistbelt attachment strap are adapted to be adjustably secured to a pair of buckles which are fixedly attached to opposite sides of the elongated waistbelt sheath. Unlike prior art baby carrier harnessing systems which typically utilize a crossover rear strap arrangement, each of the yoke to waistbelt straps extends directly under the arms of the wearer from the rear portion of the yoke to the elongated waistbelt sheath.

DETAILED DESCRIPTION OF THE INVENTION

Figure 1:
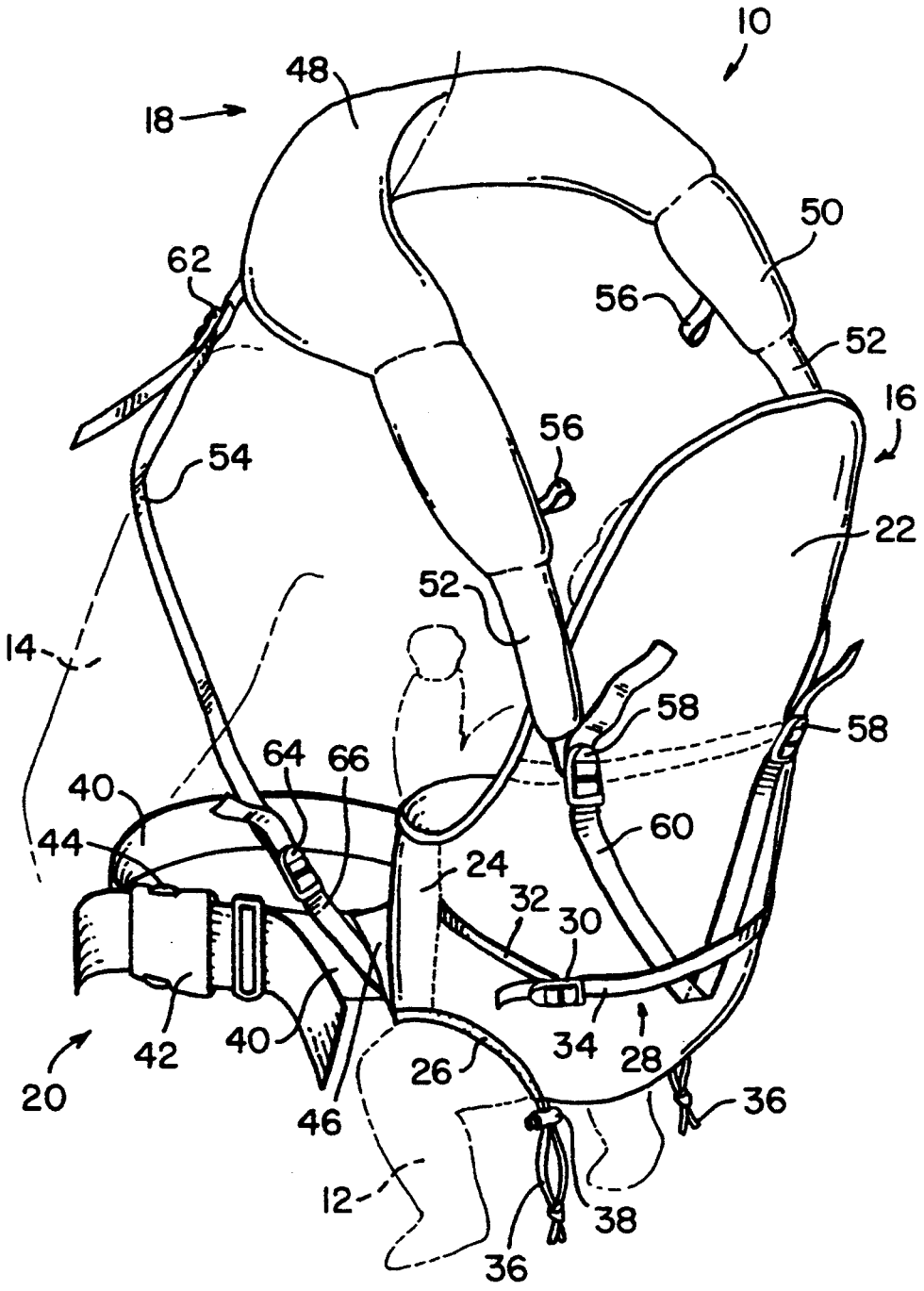
FIG. 1 is a perspective view of a baby carrier according to a preferred embodiment of the present invention with a baby and the wearer of the carrier illustrated in phantom.

Referring now specifically to the drawings, there is illustrated a soft-type baby carrier, generally designated as 10, according to a preferred embodiment of the present invention, wherein like reference numerals refer to the same components throughout the drawings.

A detailed perspective view of the baby carrier 10, with a baby 12 and the wearer 14 of the baby carrier shown in phantom, is provided by FIG. 1. In particular, the baby carrier 10 includes a pouch shaped baby seat 16 for supporting the baby 12 therein, an adjustable yoke harnessing system 18 for supporting the pouch shaped baby seat about the neck and back of the wearer 14 and an adjustable waistbelt 20.

Figure 3:
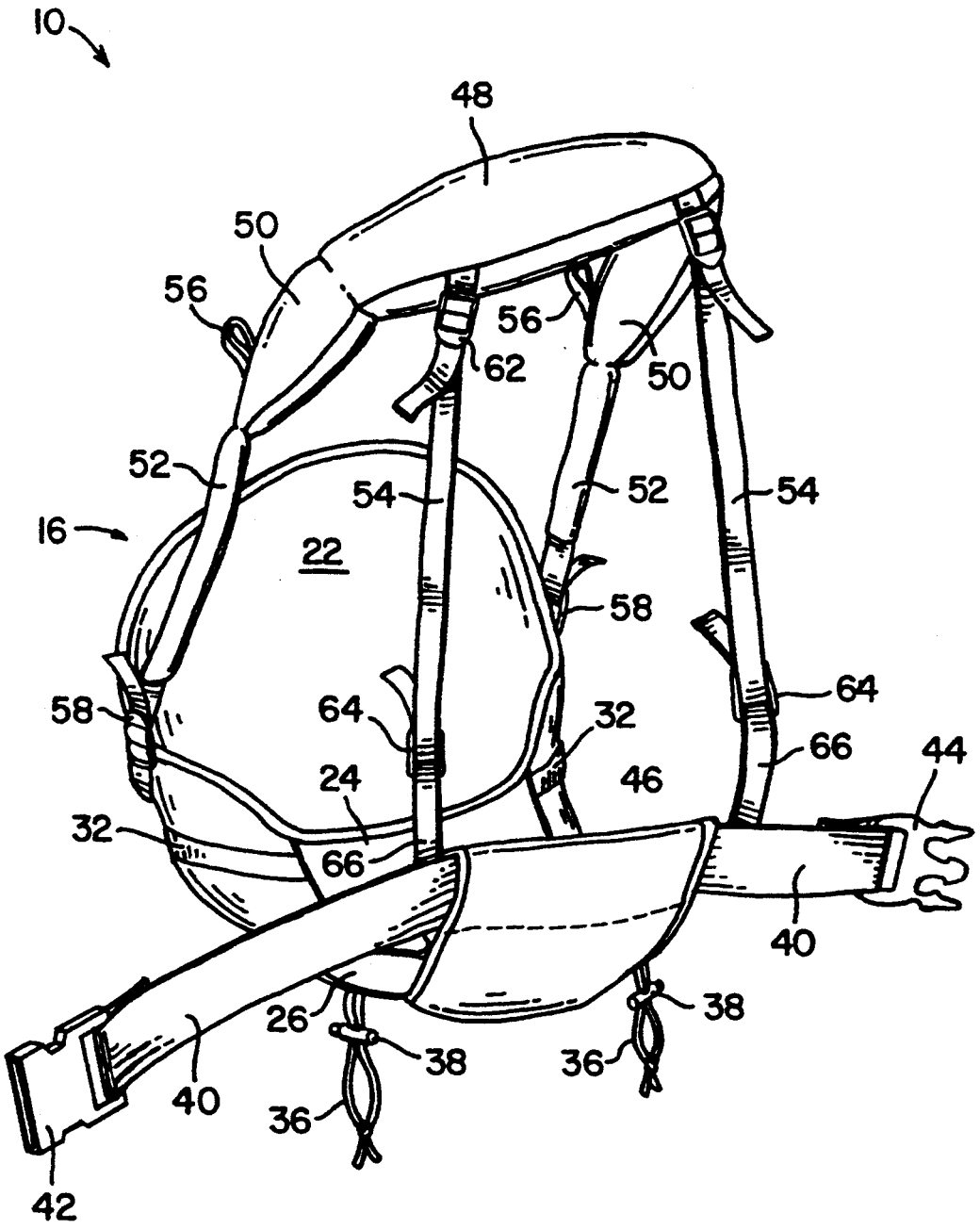
FIG. 3 is a rear perspective view of the baby carrier.

As illustrated most clearly in FIGS. 1 and 3, the pouch shaped baby seat 16 includes a padded, upwardly extending support panel 22 for supporting and partially encircling the buttock, back, neck and head areas of the baby 12, a nonpadded, upwardly extending support panel 24 for encircling and supporting the front torso of the baby, two size-adjustable leg openings 26 and a size adjustable strap arrangement 28 for securing the baby within the pouch shaped baby seat 16.

The size adjustable strap arrangement 28 includes two buckles 30 symmetrically positioned on opposite sides on the front (forwardly facing), exterior side of the padded, upwardly extending support panel 22 and two straps 32 each having a first end section which is adapted to be adjustably received in one of the buckles 30 and a second end section which is fixedly attached to opposing sides of the nonpadded, upwardly extending support panel 24. A transversely extending support strap 34 extends between the buckles 30, across the front, exterior side of the padded, upwardly extending support panel 22.

Each of the leg openings 26 in the pouch shaped baby seat 16 includes a size adjustment cord 36 which extends about at least a portion of the periphery of the leg opening. To adjust the circumference of a leg opening 26, a knotted, looped section of the cord 36 is inserted through a hole in a slidable, spring biased stop member 38.

Figure 4:
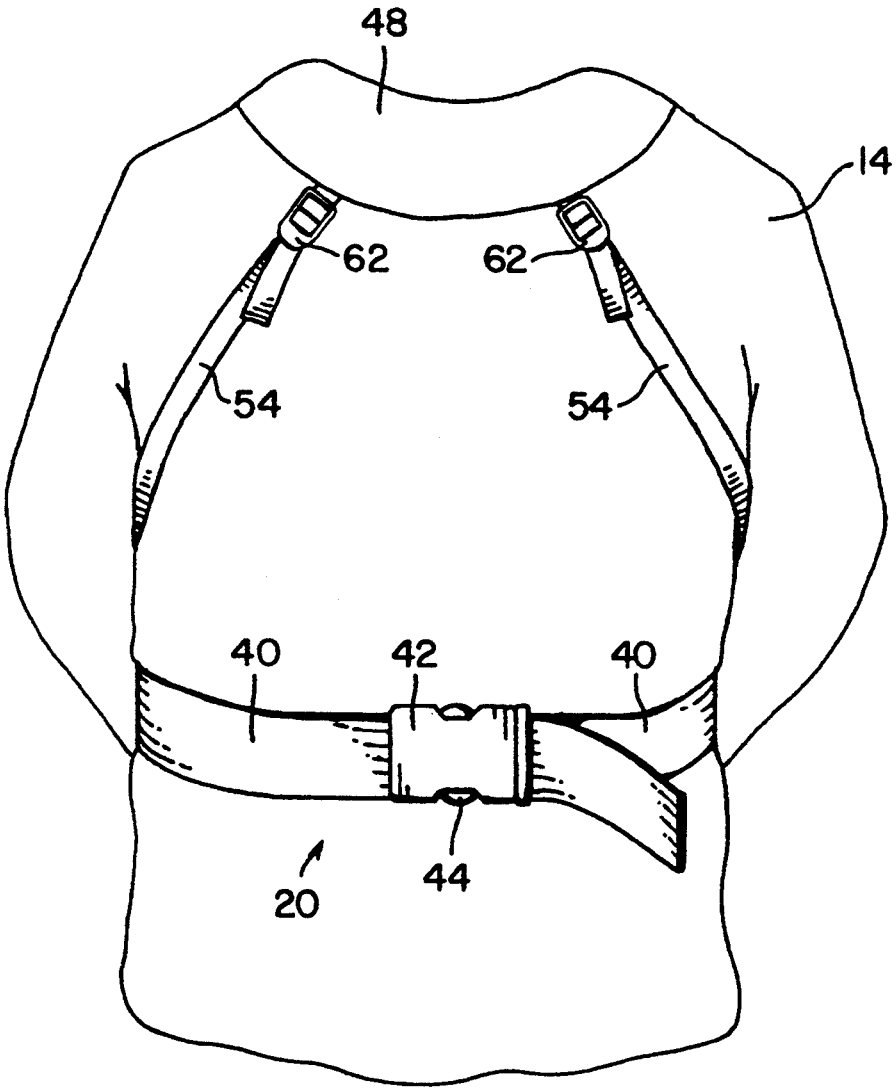
FIG. 4 illustrates the manner in which the waistbelt and yoke harnessing system are secured about the torso of a wearer.

Referring now to FIGS. 1 and 3–4, the adjustable waistbelt 20 incorporates first and second end portions 40 each having complementary buckle members 42, 44 adjustably positioned proximate opposing ends thereof. As illustrated in FIG. 4, the waistbelt 20 is fastened about the torso of the wearer 14 by suitably interconnecting the complementary buckle members 42, 44. Further, the operational circumference of the waistbelt 20 may be adjusted by sliding the buckle members 42, 44 to appropriate positions along the first and second end portions 40 of the waistbelt.

The adjustable waistbelt 20 is secured to the pouch shaped baby seat 16 by slidably inserting a section thereof through an elongated sheath 46 located proximate a bottom region of the size adjustable leg openings 26, below the intersection of the padded and nonpadded, upwardly extending support panels 22 and 24, respectively.

The soft-type baby carrier of the present invention is comfortably supported on the torso of the wearer 14 with an adjustable yoke harnessing system 18. More specifically, as detailed in FIGS. 1–4, the yoke harnessing system includes a padded yoke having a rear portion 48 which encircles the rear neck area of the wearer and first and second opposing end portions 50 which extend forwardly over the shoulders of the wearer, a pair of adjustable yoke to baby seat attachment straps 52, a pair of adjustable yoke to waistbelt straps 54 and a pair of bib loops 56.

Figure 2:
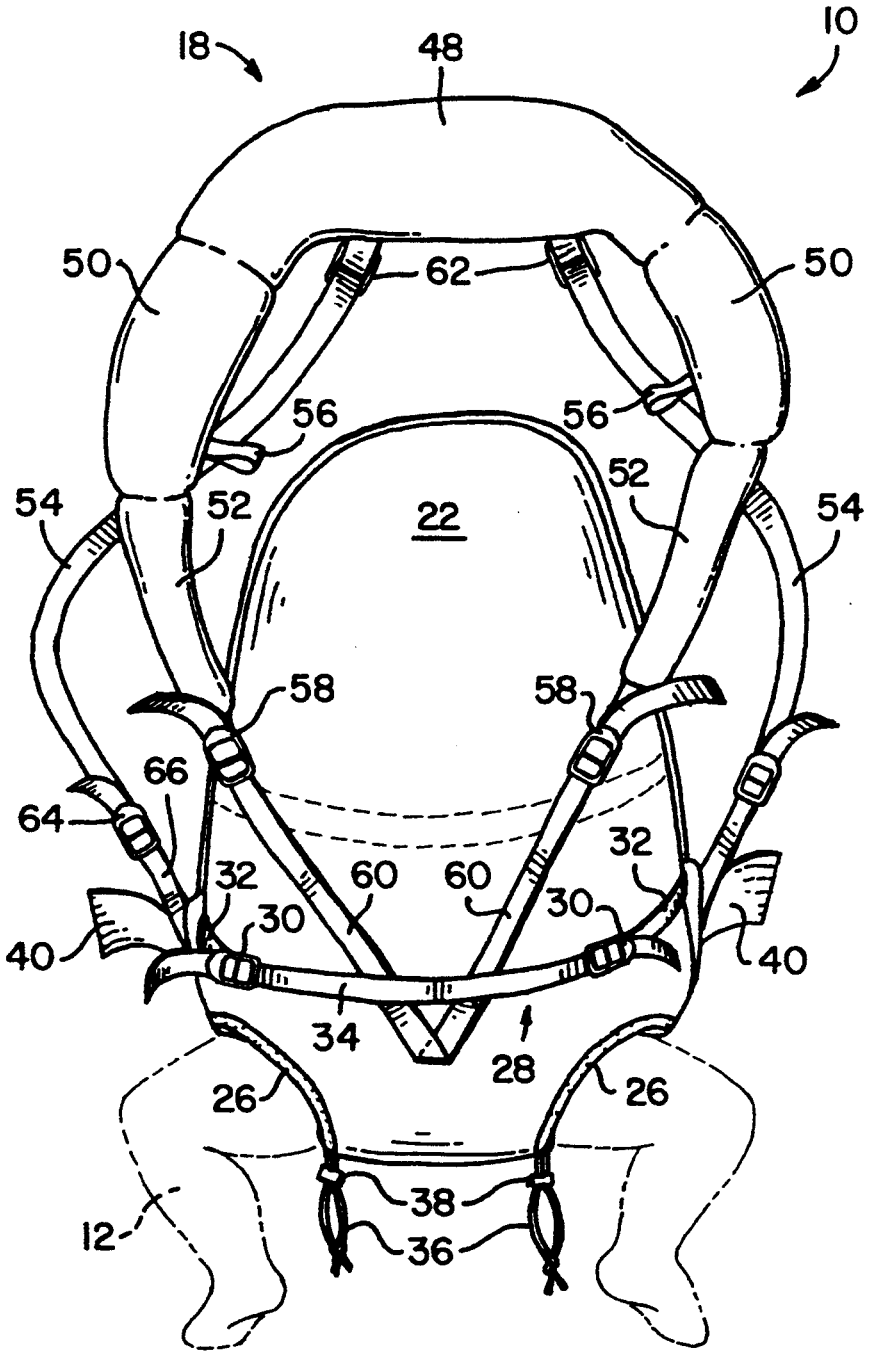
FIG. 2 is a front perspective view of the baby carrier.

The adjustable yoke to baby seat attachment straps 52 are adjustably secured proximate a first end thereof to a pair of buckles 58 which are symmetrically disposed on opposite sides of the front, exterior side of the padded, upwardly extending support panel 22. As illustrated in FIGS. 1 and 2, a pair of intersecting support straps 60 extend diagonally downward from the buckles 58 across the front, exterior side of the padded support panel 22 in a V-shaped configuration, wherein each support strap 60 is affixed along its entire length to the padded support panel 22. As further shown in FIGS. 1–2, each of the adjustable yoke to baby seat attachment straps 52 may be covered with a layer of padding.

Each of the adjustable yoke to waistbelt straps 54 includes a first end portion which is adjustably fastened to a buckle 62 which is suitably mounted on the rear portion 48 of the padded yoke. Similarly, the opposite end portion of each yoke to waistbelt strap 54 is adjustably fastened to a buckle 64 which is secured to the elongated sheath 46 proximate a side opening thereof with an extension strap 66. As clearly illustrated in FIGS. 1 and 4, the yoke to waistbelt straps run directly under the arms of the wearer 14 from the rear portion 48 of the padded yoke to the elongated waistbelt sheath 46.

The foregoing description of the preferred embodiments of the invention has been presented for purposes of illustration and description. It is not intended to be exhaustive or to limit the invention to the precise form disclosed, and obviously many modifications and variations are possible in light of the above teaching. For example, the position of the pouch shaped baby seat may be shifted from the front torso area of the wearer to either hip by suitably readjusting the attachment straps and the waistbelt. Such modifications and variations that may be apparent to a person skilled in the art are intended to be included within the scope of this invention as defined by the accompanying claims.

I claim:

1. A baby carrier for supporting a baby in a rearwardly facing direction proximate an anterior portion of a wearer's torso comprising:

a baby seat having a pouch for supporting said baby in a rearwardly facing direction, said pouch including first and second upwardly extending support members for supporting rear and front portions of said baby, respectively, said support members forming leg holes for receiving the legs of said baby therethrough;

a waistbelt for adjustably attaching said baby carrier about a waist portion of said wearer's torso, said waistbelt being secured to said pouch proximate a bottom region of said leg holes;

means for supporting said baby carrier about the neck of said wearer, said supporting means including a yoke having a rear portion which is adapted to encircle the rear of the wearer's neck and opposing end portions which are adapted to extend over the front of the wearer's shoulders, said supporting means further including a first pair of straps for adjustably fastening the opposing end sections of said yoke to a front, exterior portion of said first upwardly extending support member, and a second pair of straps having first and second ends, said first ends each independently secured to a disparate section of the rear portion of said yoke and said second ends secured to said waistbelt, for adjustably fastening the rear portion of said yoke to said pouch proximate a bottom region of said leg holes, said second pair of straps passing under the arms of said wearer.

2. The baby carrier according to claim 1 wherein said pouch further includes means for adjusting the size of said leg holes.

3. The baby carrier according to claim 1 wherein said pouch further includes means for adjustably tightening the first and second upwardly extending support members about the torso of said baby.

4. The baby carrier according to claim 1 wherein said first upwardly extending support member includes a transversely disposed support strap, said support strap extending across the front, exterior portion of said first support member.

5. The baby carrier according to claim 1 wherein the means for securing the baby carrier about the neck of said wearer further includes means for removably affixing a bib thereto.

6. The baby carrier according to claim 5 wherein said bib affixing means includes at least one loop, said loops being secured proximate the opposing end portions of said yoke.

7. The baby carrier according to claim 1 wherein each of the first pair of straps includes an end section which is secured across the front, exterior portion of the first upwardly extending support member.

8. The baby carrier according to claim 7 wherein the end sections of said first pair of straps are secured across the first upwardly extending support member in a V-shaped configuration, said straps intersecting at the apex of said V-shaped configuration.

9. The baby carrier according to claim 1 wherein said second pair of straps do not intersect each other.

* * * * *